United States Patent [19]

Turner et al.

[11] Patent Number: 4,830,709

[45] Date of Patent: May 16, 1989

[54] MULTI-PLY WEB FORMING APPARATUS AND METHOD

[75] Inventors: James A. Turner, Beech Hill; Paul T. Gray, Bolton, both of Great Britain

[73] Assignee: Beloit Corporation, Beloit, Wis.

[21] Appl. No.: 88,458

[22] Filed: Aug. 24, 1987

[30] Foreign Application Priority Data

May 1, 1987 [GB] United Kingdom ..... 8710428

[51] Int. Cl.[4] ..... D21F 11/04; D21H 1/06

[52] U.S. Cl. ..... 162/133; 162/203; 162/217; 162/301; 162/304; 162/364

[58] Field of Search ..... 162/123, 132, 133, 203, 162/202, 217, 300, 301, 303, 304, 348, 364

[56] References Cited

U.S. PATENT DOCUMENTS

| | | | |
|---|---|---|---|
| 3,403,073 | 9/1968 | Moran | 162/203 |
| 3,681,193 | 8/1972 | Nykopp | 162/300 |
| 3,726,758 | 4/1973 | Parker et al. | 162/301 |
| 3,954,554 | 5/1976 | Curry et al. | 162/104 |
| 3,992,254 | 11/1976 | Lehtinen | 162/300 |
| 3,994,771 | 11/1976 | Morgan et al. | 162/113 |
| 4,074,959 | 2/1978 | Curry et al. | 162/203 |
| 4,154,645 | 5/1979 | Kankaanpan | 162/133 |
| 4,207,144 | 6/1980 | Meinecke et al. | 162/304 |
| 4,414,061 | 11/1983 | Trufitt et al. | 162/295 |
| 4,523,978 | 6/1985 | Pullinen | 162/300 |
| 4,557,802 | 12/1985 | Waris | 162/301 |
| 4,609,435 | 9/1986 | Tissari | 162/203 |

FOREIGN PATENT DOCUMENTS

| | | | |
|---|---|---|---|
| 136000 | 4/1985 | European Pat. Off. | 162/301 |
| 2221578 | 10/1974 | France . | |
| 1336713 | 11/1973 | United Kingdom | 162/133 |

*Primary Examiner*—David L. Lacey
*Assistant Examiner*—K. M. Hastings
*Attorney, Agent, or Firm*—Dirk J. Veneman; Raymond W. Campbell; Gerald A. Mathews

[57] ABSTRACT

A multi-ply paper web forming apparatus utilizes first and second forming wires which travel in a co-running path for a portion of their length and which form a throat into which an aqueous slurry of paper pulp fibers is introduced. The slurry is dewatered between the co-running first and second forming wires upwardly and downwardly to quickly produce a substantially formed, but still moist, top ply web which is carried on the second forming wire onto a base ply web which has previously been formed on the wire of a single wire former. The first surface of the top ply web is brought into ply bonding engagement with the surface of the base ply web to produce a composite multi-ply web which has superior overall ply bond, retention and dryness before leaving the web forming section of a papermaking machine.

12 Claims, 3 Drawing Sheets

12
16
16
16
16
8
20
14
17
17
17
17
17
17
22
24
27
26
28
30
133
233
32
15
34
19
36
Wc
WT
WB
10
18

20b
21
16b
17b
10b
Wc
22b
17b
17b
56
24b
26b
17b
12b
16b
30b
28b
32b
133b
16b
233b
54
19b
16b
34b
17b
13
WB
11b
WT
18b

MULTI-PLY WEB FORMING APPARATUS AND METHOD

BACKGROUND OF THE INVENTION

This invention relates to the art of papermaking. More particularly, it relates to the art of multi-ply papermaking which is sometimes referred to as boardmaking. Still more particularly, this invention relates to the art of producing separate plies of paper web individually with a plurality of forming wires and bringing the separately produced web plies together to effect ply bonding into a composite board. The resultant product is then removed from the forming section of the papermaking machine and transferred to pressing, drying and winding stations for further processing.

Typical examples of prior multi-ply web forming apparatus are shown and described in U.S. Pat. Nos. 3,681,193 (Nykopp), 3,726,758 (Parker et al) and 3,954,554 (Curry et al). Typically, prior multi-ply web forming apparatus either form the top ply with minimum dewatering through its lower side (Parker et al), or dewater the top ply only through one side (the lower side) of a horizontally-extending forming unit (Curry et al), or quickly form the top ply over a roll former with the side to be bonded to the base ply dewatered significantly more than the other side (Nykopp). Each of these structures has disadvantages which result in either a composite multi-ply web being formed more slowly than economically permissible in today's competitive environment, or wetter. Conversely, the composite web product might be formed at a competitive speed, but the resulting product would be either lighter in weight than desired or possess insufficient ply bonding to provide a saleable product, or both.

Such ply bonding deficiencies can be generally attributed to decreased affinity between webs which have lower fines content in their mating faces. Also, especially where either or both of the mating plies contain an abundance of fines, which promote ply bonding, excessive speed in the rate of water removal through the faces of the plies to be mated adversely affects ply bonding because it tends to draw a greater amount of fillers to the surface. Fillers do not enhance ply bonding.

SUMMARY OF THE INVENTION

The problems associated with the high speed production of a multi-ply paper, or board, product of substantial weight are obviated by this invention.

The top ply is formed between two forming wires along a gently undulating path where the dewatering process is carried out through both its faces to produce a web which has a more uniform distribution of fines, fillers and fibers on both its sides, thus providing its surfaces with a greater affinity for ply bonding. This dewatering through both sides not only produces a more uniform, one-sided web (i.e. a web wherein both sides are more nearly the same after the dewatering process), but in addition, this degree of dewatering of the top ply is accomplished quickly so it can have a higher caliper and still be brought into ply bonding contact with the surface of the base ply which may be formed on an ordinary fourdrinier-type papermaking machine. Thus, this apparatus is especially suitable for use in modifying existing fourdrinier-type papermaking machines to produce composite, multi-ply board with little or no other modification necessary on the papermaking machine.

If desired, however, formation of the base ply itself can be done with two forming wires so that the surface on the other side of the fourdrinier wire has at least a degree of dewatering done through it. This permits either a shorter fourdrinier wire to be used, with the concomitant advantage of less machine space required and, further, the papermaking machine can be operated at a faster speed while still achieving superior ply bonding with the top ply.

Thus, by dewatering through both surfaces of both the top and base plies, formation of the individual plies is accomplished faster and, equally important, the ply faces which come into ply bonding engagement are better prepared, by virtue of having more fines and less fillers at their surface, to remain permanently bonded together.

By way of example only, tests have produced composite webs of 200 g/m$^2$ at 700 m/mixture and 280 g/m$^2$ at 200 m/minute. This is by no means an indication of the limits of this apparatus.

Accordingly, it is an object of this invention to provide a multiple forming wire, multi-ply web forming apparatus to dewater both sides of at least the top ply of a multi-ply composite web to provide enhanced ply bonding.

It is another object of this invention to provide a multi-ply web forming apparatus capable of forming a relatively high caliper multi-ply web at relatively high speeds.

Still another object of this invention is to provide a three forming wire, multi-ply web forming apparatus wherein the outer face of the composite product, and the face of the ply coming into ply bonding engagement with the base ply have both been dewatered through a forming wire to enhance both the speed of formation and strength of the final product.

Another object of this invention is the provision of a multiple forming wire, multi-ply web forming apparatus which promotes high fines and fiber retention in the plies being produced and formed into a composite web paper product.

A feature of this invention is the dewatering of the to ply in a multi-ply web forming apparatus through both sides.

Another feature of this invention is the provision of apparatus whereby both the top and base plies are dewatered through both of their surfaces prior to coming into ply bonding engagement to form the composite web product.

These, and other objects, features and advantages of this invention will become readily apparent to those skilled in the art upon reading the description of the preferred embodiment in conjunction with the attached drawings.

DESCRIPTION OF THE PREFERRED EMBODIMENTS

Figure 1:
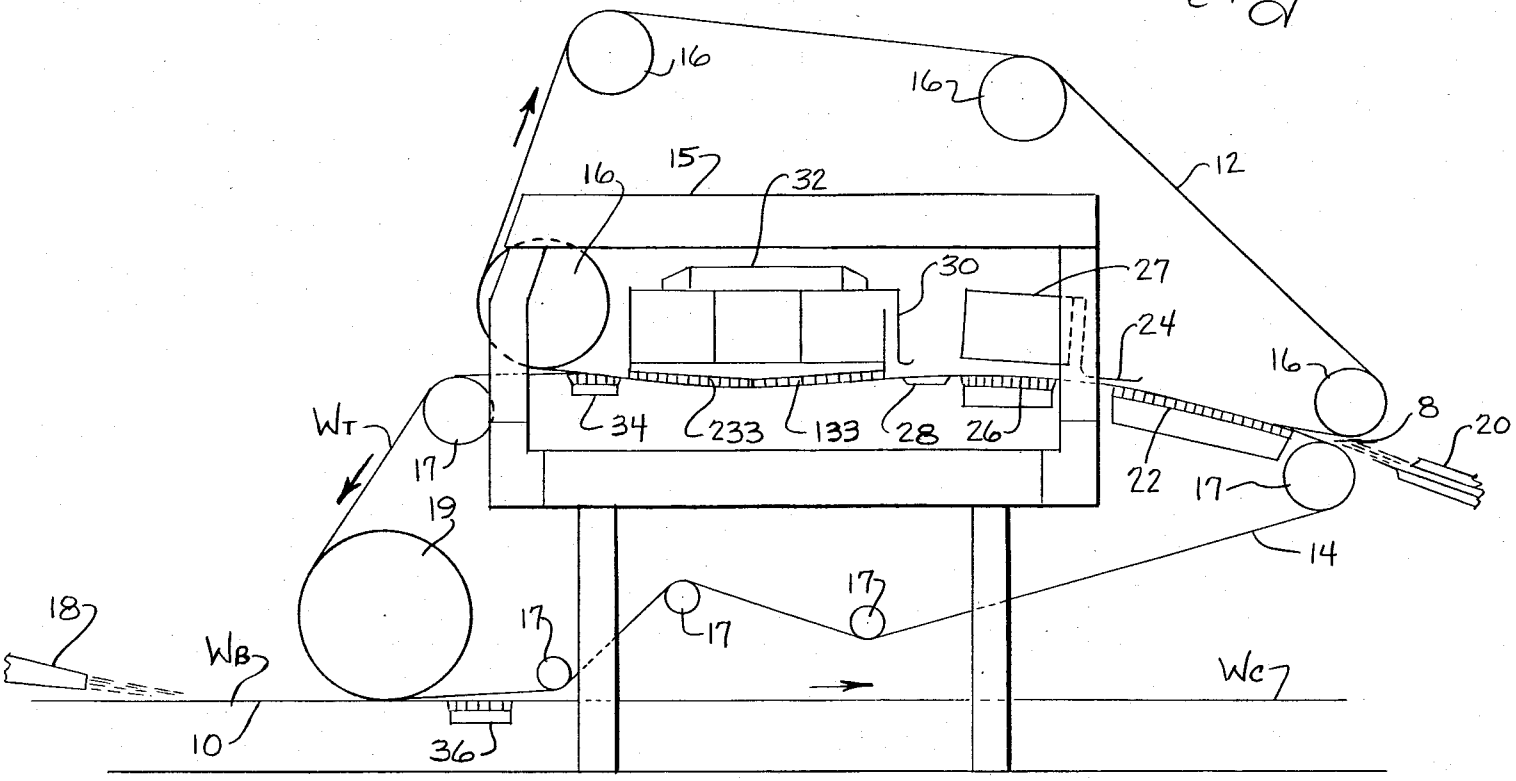
FIG. 1 is a side elevational view of a two-wire top ply forming apparatus above a horizontally traveling fourdrinier wire on which a base ply web has been formed.

Referring to FIG. 1, a base ply headbox 18 discharges an aqueous slurry of wood pulp fibers, commonly known as "stock" in the paper industry, onto a fourdrinier wire 10 traveling in the direction of the arrow to form a base ply web. For purposes of illustration, the headbox 18 is shown closely upstream of lead-in roll 19 and it is understood that this is not to scale and the actual distance between the headbox 18 and lead-in roll 19 would be greater than shown. It is also understood that insofar as the formation of the base ply web on the fourdrinier in FIG. 1 is concerned, the stock slurry is presumed to have been deposited on the fourdrinier wire and dewatered in a conventional manner prior to reaching the lead-in roll 19. Further in this regard, in the papermaking art, as referred to in this invention, the term "stock" represents a slurry of water and fibers passing from the headbox to the fourdrinier, or forming, wire. The slurry continues to be dewatered as different degrees of dryness are reached. Thus, the slurry continues to be "stock" as long as fiber orientation and transfer of fiber, fillers and fines continues to occur.

Positioned above the fourdrinier wire 10 are first and second forming wires 12,14, respectively, which are each looped about a plurality of guide rolls 16,17, respectively. The second forming wire is also looped about lead-in roll 19 which guides the wire, and the top ply web it is carrying, onto the base ply web. These first and second looped forming wires come together and define a converging throat 8 at the beginning of a co-running portion of their length where they travel together before being directed apart, as described later.

As the forming wires converge in the throat 8, they are guided onto a forming shoe 22 which is disposed beneath, and curved concave-inwardly of, the second looped forming wire 14. Located downstream of the forming shoe 22, within the first forming wire 12, is a first autoslice 24 which gathers water which has been expressed inwardly in the looped forming wire 12 by the tension of the co-running forming wires over forming shoe 22. Downstream of the first autoslice, and within the second forming wire 14, is a curved dewatering shoe 26. This dewatering shoe is curved in the same concave-inward direction as the forming shoe 22 and its surface is preferably blank, or non-foraminous or impervious.

Closely following the dewatering shoe 26, and also disposed within the looped second forming wire 14, is a pressure foil 28. This pressure foil 28 is beneath and somewhat forward of a second autoslice 30 which is mounted within the looped upper forming wire 12.

Immediately following the second autoslice is a curved, inverted dewatering shoe 32 mounted within the first forming wire with its surface curved concavely inwardly of the first forming wire 12.

Downstream of the curved, inverted dewatering shoe 32 is a transfer box 34 located within the second forming wire 14.

The surfaces of forming shoe 22 and dewatering shoes 26,32 can be defined in several ways. They are all designed to admit water from the web in the dewatering process and, therefore, are water pervious and foraminous in nature. In a preferred embodiment, their surface is defined by a plurality of closely spaced, parallel foils which extend in the cross-machine direction. These foils thus define, in conjunction with the forming wires traveling thereover, a plurality of short chords which approximate a curved surface.

In another preferred embodiment, the surfaces of forming shoe 22 and dewatering shoes 26,32 are formed of a curved cover in which are formed a plurality of uniformly spaced slots or perforations to admit water from the forming wires passing thereover.

Regardless of the type of surface of forming shoe 22 and dewatering shoes 26,32 they can either be connected to a source of vacuum pressure or be operated without any vacuum pressure assistance. The vacuum pressure would urge water inwardly of the shoes for collection and discharge from the forming appartus. However, the inverted dewatering shoe 32, being mounted within the first forming wire 12 with its face pointing downwardly, will essentially always be operated with vacuum assistance.

In operation, a secondary headbox 20 projects a stock stream into throat 8 in a slightly upwardly direction relative to the plane of the substantially horizontal fourdrinier wire 10. As the upper and lower forming wires 12,14 are directed by the initial guide rolls 16,17 to converge over the curved forming shoe 22, water is urged downwardly within the forming shoe 22 and some water is expressed upwardly within the looped first forming wire 12 by the tension of the forming wires traveling over the forming shoe 22. This water expressed into the first forming wire is scooped up by the first autoslice 24 which collects it into a collection pan 27 for removal.

Still traveling in a gentle, concave downwardly curve, the co-running forming wires come onto the surface of dewatering shoe 26 where additional water is urged downwardly by the action of foil blades or other type of foraminous surface which may be operating in conjunction with a vacuum source.

Pressure foil 28 performs two functions. First, it changes the curvature of the co-running forming wires from concave-downwardly over the forming shoe 22 and dewatering shoe 26 to concave-upwardly in conjunction with dewatering shoe 32. Secondly, its smooth, continuous surface prevents water from entering the second forming wire 14, so all of the water is expressed upwardly within the looped first forming wire 12 where the free water is scooped up by the second autoslice 30 for collection and removal from the apparatus.

The co-running forming wires then pass over the foraminous surfaces of compartments 133,233 of the curved, inverted dewatering shoe 32. The surfaces of dewatering shoe 32 are curved concave upwardly and compartments 133 and 233 are subjected to vacuum pressure which may differ in each compartment. Thus, the traveling web is subjected to gentle, upward dewatering over a relatively long distance over the surface of the curved dewatering shoe 32. The shoe can incorporate one or more compartments 133, 233. The co-running forming wire then travel over web transfer box 34 which has a vacuum pressure applied to its foraminous cover to urge the web onto the second forming wire 14. The top wire then continues its looped path of travel over guide rolls 16 on first forming wire 12 while the web is carried on the second forming wire 14 over guide rolls 17. In its downward path of travel on the second forming wire 14, top web $W_T$ is brought into co-running, touching engagement with base ply web $W_B$ which has been previously formed the base ply wire 10 by the base ply headbox 18. This forms a composite web $W_C$ having its top surface comprising the upper surface of web $W_T$ coming into engagement with the upper surface of base ply web $W_B$. The composite web $W_C$ then passes over a suction transfer box 36 which applies vacuum pressure to the composite web to urge it to remain on the fourdrinier wire 10 while the second forming wire 14 is directed away by guide rolls 17.

Figure 2:
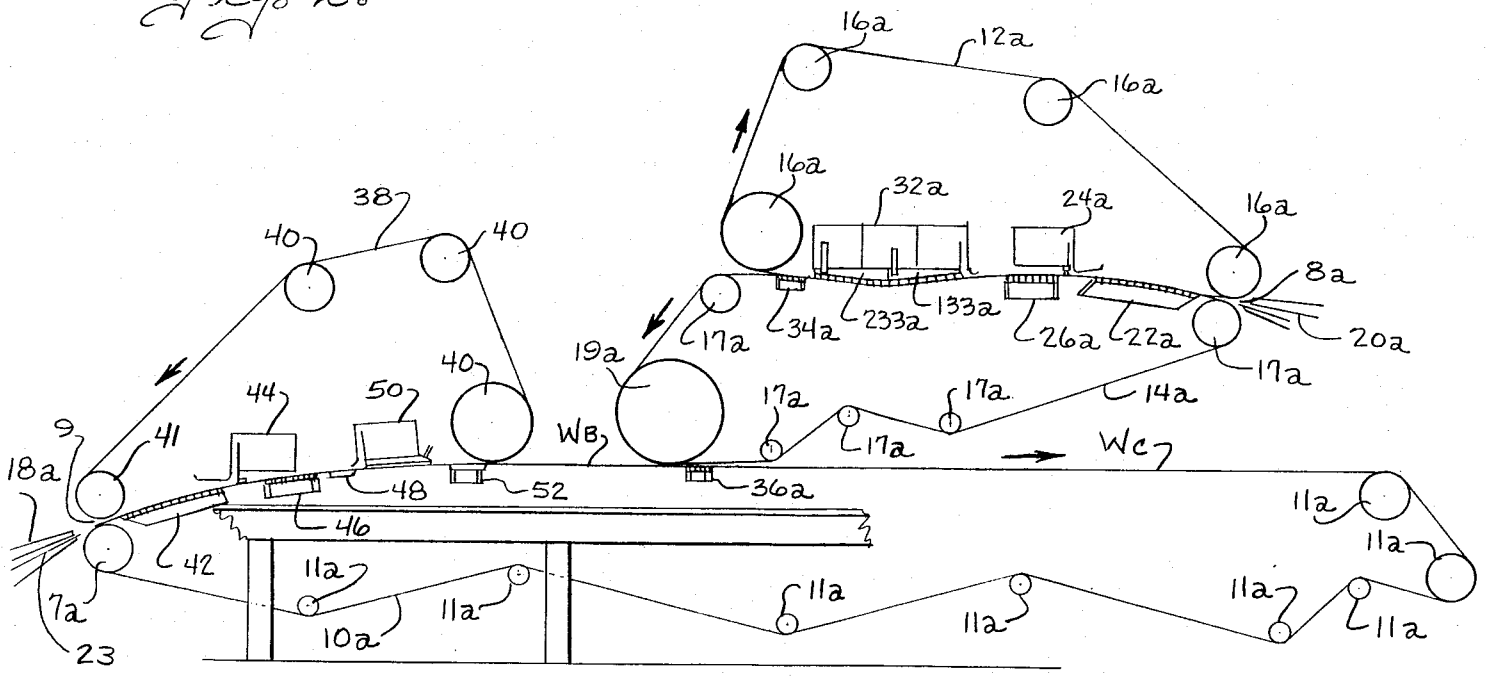
FIG. 2 is a side elevational view of a two-wire base ply forming apparatus wherein the base ply is formed between an upper forming wire disposed over the upstream end of a fourdrinier wire, and a top ply web is formed between a pair of forming wires disposed upstream over the fourdrinier wire wherein the top ply is brought into ply bonding engagement with the base ply on the fourdrinier wire.

Referring to FIG. 2, the top web ply $W_T$ is formed in the same manner as the top ply described in conjunction with FIG. 1. Further, in FIGS. 2 and 3, corresponding elements have the same numerical designation, but with different letter suffixes to distinguish corresponding elements in the various embodiments. Thus, the "a" suffix is used in conjunction with corresponding elements in FIG. 2 and the "b" suffix is used to identify corresponding elements in the embodiment of FIG. 3.

In FIG. 2, the base ply $W_B$ is also formed with a two-wire apparatus. The lower wire is the upstream end of fourdrinier wire 10*a* which is curved concave-downwardly at its upstream end from its normal path of travel in a horizontal plane. The looped fourdrinier wire 10*a* is guided by a plurality of base ply guide rolls 11*a* and its concave-downwardly curvature at its upstream end is defined by a base ply forming shoe 42, base ply dewatering shoe 46, base ply pressure foil 48 and base ply web transfer box 52 disposed within the forming wire 10*a*. A base ply top wire 38 is disposed above the curved upstream end of fourdrinier wire 10*a*. This forming wire 38 is looped about base ply top wire guide rolls 40 and a lead-in roll 41.

A base ply headbox 18a projects a stock stream into a throat 9 formed by the top wire 38 and fourdrinier wire 10*a* after they pass over lead-in rolls 7*a*, 41. The base ply may comprise either a multi-ply web, made by emitting a composite jet stream of stock, or a single ply web, made by a uniform jet stream of stock. A multi-ply web can be produced by providing a flexible element 23 which divides the headbox into upper and lower compartments extending horizontally. Thus, a separate supply of stock can be provided in each of the upper and lower compartments. The stock in each compartment can have different physical properties. The separated streams of stock emerge near the headbox slice, or exit, and continue to flow along together in substantially laminar flow. If such a divided headbox is provided for both headboxes 18*a*, 20*a*, a four compartment multi-ply web can be produced. Naturally, if only one type of stock is provided into headbox 18*a*, the base ply will be single ply. Immediately downstream of the throat 9, the co-running forming wires 38, 10*a* are directed onto a base ply forming shoe 42 having a plurality of foil blades extending in the cross-machine direction to define the concave-downwardly curved surface of the forming shoe 42. As in other forming shoes having their surfaces defined by a plurality of foils, the forming shoe blades generate pulsations in the stock. These pulsations have pressure peaks which have a dispersing effect on the individual fibers that mobilizes them and maintains their dispersed condition during the dewatering process. The paper web which is gradually formed as the water is withdrawn has more uniform sheet properties and formation.

Downstream of the base ply forming shoe 42, within the looped base ply top wire 38, is a first base ply autoslice 44 which scoops up and collects the free water which has been expressed through the forming wire 38 by the tension of the forming wires passing over the forming shoe 42.

Downstream of the autoslice 44, but within the fourdrinier wire 10*a*, and still in the concave-downwardly curved portion of the looped fourdrinier wire, is a base ply dewatering shoe 46. The surface of dewatering shoe 46 is also preferably formed by a plurality of parallel, closely spaced foil blades extending in the cross-machine direction. However, the surface could also comprise a curved surface having a plurality of foramina to permit water to pass through for discharge. Also, either or both of forming shoe 42 and dewatering shoe 46 may have a source of vacuum pressure applied thereto to promote increased water removal.

Downstream of dewatering shoe 46, and also within looped fourdrinier wire 10a, is a base ply pressure foil 48 which is positioned closely adjacent a second autoslice 50 within the base play top wire 38. The surface of pressure foil 48 is smooth and imperforate to force water upwardly into the top wire 38 where it is skimmed off and collected by autoslice 50.

Finally, further downstream within looped fourdrinier 10*a* is a base ply web transfer box 52 which is under vacuum pressure to urge the web onto the lower wire 10*a* as the top wire 38 is directed away. Web transfer box 52 also defines the end of the concave downwardly curvature of wire 10*a*.

Thus, web $W_B$ is formed on the lower wire 10*a* in a substantially dewatered condition so that when the top ply web $W_T$ is applied thereon over the lead-in roll 19*a*, the upper surface of webs $W_B$, $W_T$ have been substantially dewatered although they are still wet enough to effect good ply bonding. This allows a relatively bulky, high caliper composite web $W_C$ to be produced at relatively high speed on a horizontally-arrayed papermaking machine.

Figure 3:
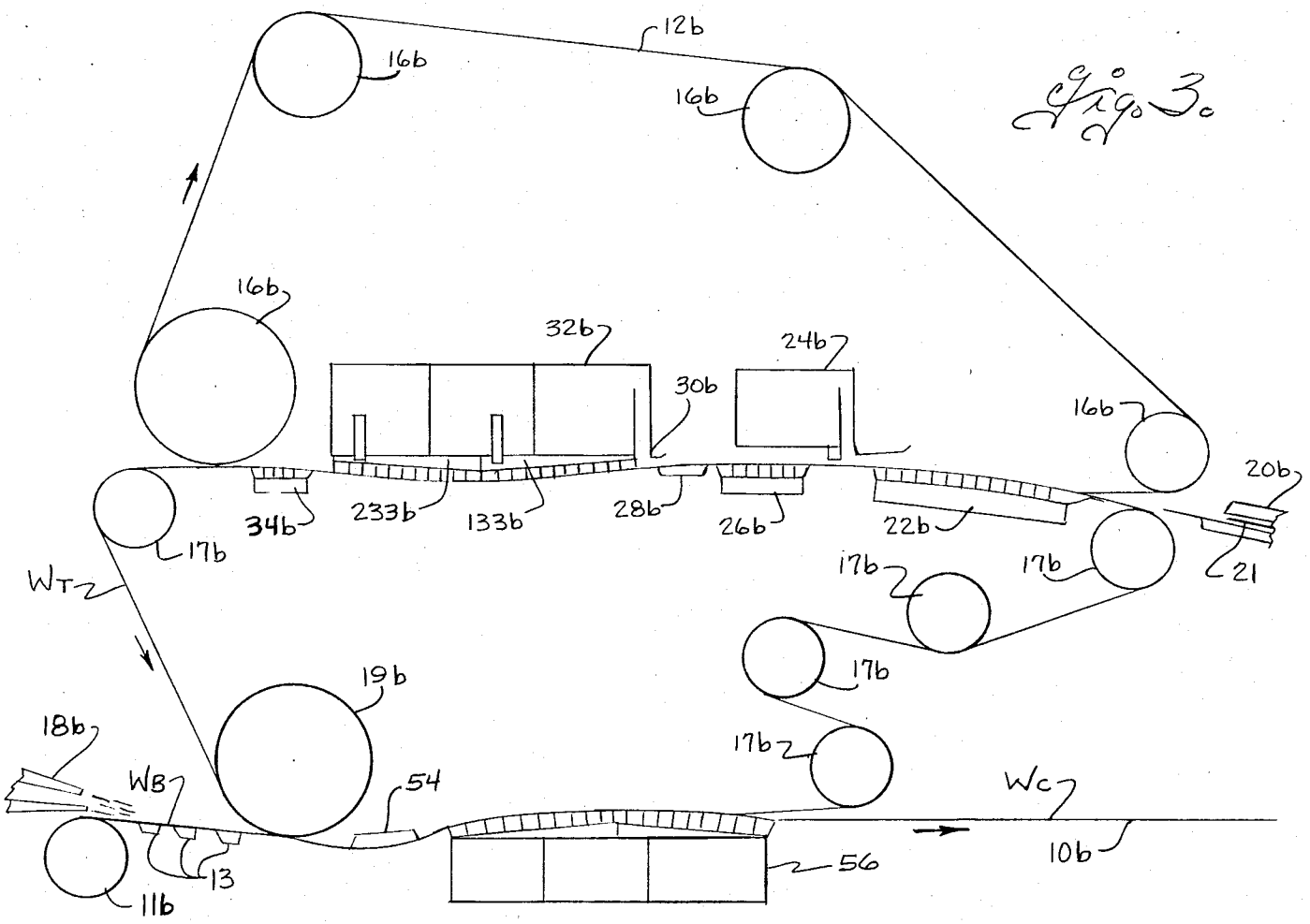
FIG. 3 is a side elevational view of a three-wire, multi-ply former which utilizes some of the components of the apparatus shown in FIGS. 1 and 2.

Referring now to FIG. 3, the top ply web $W_T$ is formed with a secondary headbox 20*b* having a flexible divider 21 in it to separate the stock flowing on either side. This permits the top web ply to be produced from stock having two different components, or two separate stocks coming from separate sources. Thus, the top stock component can be of cheaper quality since it will ultimately be an inner layer of the composite web. Besides permitting the usage of a cheaper stock in the upper component of the stock issuing from the secondary headbox, the lower component can comprise a furnish which is more suitable to printing and/or has higher strength characteristics. Thus, the lower component can be much thinner if it is more expensive.

The base web ply $W_B$, as in the embodiment shown in FIGS. 1 and 2, can pass over base ply dewatering foils 13 to provide an overall web moisture level before the ply bonding with top ply web $W_T$. After the webs $W_B$, $W_T$ have been brought into contact, they are passed over a second pressure foil 54 within the looped second forming wire 14b over the fourdrinier wire and directed onto a concave-downwardly base ply vacuum box 15 within the lower wire 10*b*. As the composite web passes over the compartmented base ply vacuum box 56, additional dewatering can be effected through the uppermost layer of the top web ply $W_T$ downwardly through the base ply $W_B$ on lower wire 10*b*. This also promotes increased ply bonding between the top and base web plies.

What is claimed is:

1. Apparatus for forming a multi-ply paper fiber web in combination with a fourdrinier wire on a fourdrinier-type papermaking machine, the apparatus comprising:

means for forming a base ply web on the fourdrinier wire along a path;

a top former disposed above the fourdrinier for forming at least a single top web ply, said top former having (a) first and second looped forming wires disposed in opposed array in a co-running path of travel above the fourdrinier wire, (b) guide means within each of the first and second forming wires to coverge them to define a throat, and to diverge them downstream thereof at the end of their co-running path of travel, (c) a headbox for supplying a stream of stock to the throat to initiate formation of a top web ply having first and second face surfaces between the first and second forming wires, (d) a curved forming shoe within the second looped forming wire for dewatering the top web ply through its second face surface, (e) a first auto-slice within the first looped forming wire downstream of the forming shoe, (f) a first curved dewatering shoe disposed within the second forming wire downstream of the first auto-slice, (g) a second curved dewatering shoe connected to a source of vacuum and disposed within the first looped forming wire downstream of the first curved dewatering shoe for dewatering the top web ply through its first face surface, (h) a web transfer box disposed within the second forming wire near where the wires diverge for urging the web onto the second forming wire;

the second forming wire disposed to bring the first face surface of the top web ply into contact with the base ply on the fourdrinier wire whereby the top and base web plys are bonded together.

2. The apparatus as set forth in claim 1, wherein:

the path of travel of the co-running first and second forming wires from a point where they converge at the throat to the point where they diverge adjacent the transfer box follow a path generally parallel to the path of the base ply on the fourdrinier wire, but alternately curved concavely downward over the forming shoe and the first dewatering shoe and curved concavely upward over the second dewatering shoe and going in the opposite direction to the base ply, whereby the top web ply is substantially dewatered through both surfaces and formed preparatory to being urged into ply bonding contact with the base ply.

3. Apparatus for forming a multi-ply paper fiber web in combination with a fourdrinier wire on a fourdrinier-type papermaking machine, the apparatus comprising:

means for forming a base ply web on the fourdrinier wire along a path, the means including:

(a) a base ply top wire disposed over the fourdrinier near the upstream end thereof, (b) guide means within the base ply top wire for directing the base ply top wire to form a base ply throat with the fourdrinier wire, and to direct the base ply top wire into co-running relationship with the fourdrinier wire for a distance together, (c) a base ply headbox for projecting a stock stream into the throat, (d) a base ply forming shoe disposed within the fourdrinier wire downstream of the throat for urging water from the stock stream, (e) an auto-slice within the base ply top wire downstream of the base ply forming shoe for receiving water expressed inwardly within the looped base ply top wire, (f) a base ply dewatering shoe disposed within the looped fourdrinier wire downstream of the base ply forming shoe, (g) a pressure foil disposed within the looped fourdrinier wire downstream of the base ply dewatering shoe for urging water outwardly thereover and into the co-traveling bsae ply top wire, (h) a second auto-slice disposed within the looped base ply top wire downstream of the pressure foil to receive water expressed through the base ply top wire, (i) a transfer box disposed within the looped fourdrinier wire downstream of the second auto-slice for urging the base ply to remain on the fourdrinier wire as the guide means direct the looped base ply wire away from its co-running relationship with the fourdrinier wire, whereby the base ply is substantially dewatered through both its surfaces prior to being brought into ply bonding engagement with a top ply;

a top former disposed above the fourdrinier for forming at least a single top web ply, said top former having:

(a) first and second looped forming wires disposed in opposed array in a co-running path of travel above the fourdrinier wire, (b) guide means within each of the first and second forming wires to converge them to define a throat, and to diverge them downstream thereof at the end of their co-running path of travel, (c) a headbox for supplying a stream of stock to the top former throat to initiate formation of a top web ply having first and second face surfaces between the first and second forming wires, (d) a curved forming shoe within the second looped forming wire for dewatering the top web ply through its second face surface, (e) a first auto-slice within the first looped forming wire downstream of the forming shoe, (f) a first curved dewatering shoe disposed within the second forming wire downstream of the first auto-slice, (g) a second curved dewatering shoe connected to a source of vacuum and disposed within the first looped forming wire downstream of the first curved dewatering shoe for dewatering the top web ply through its first face surface, (h) a web transfer box disposed within the second forming wire near where the wires diverge for urging the web onto the second forming wire;

the second forming wire disposed to bring the first face surface of the top web ply into contact with the base ply on the fourdrinier wire whereby the top and base web plys are bonded together.

4. The apparatus as set forth in claim 3, wherein:

the base ply forming shoe and base ply dewatering shoe are curved concavely toward the inside of the looped fourdrinier wire to define an arcuate base ply dewatering zone extending from the base ply throat to where the base ply top wire diverges from the fourdrinier wire.

5. The apparatus as set forth in claim 3, wherein:
the base ply forming and dewatering shoes have dewatering surfaces defined by plurality of foil blades.

6. The apparatus as set forth in claim 3, wherein:
either the base ply forming shoe or the base ply dewatering shoe, or both, have a source of vacuum pressure operatively associated therewith to promote entrance of water from the web thereinto.

7. A multi-ply paper web forming apparatus comprising, in combination:
a looped base ply forming wire;
a headbox for projecting a stock stream onto the base ply forming wire for forming a base ply thereon;
first and second looped forming wires disposed in opposed array in a co-running path of travel above the base ply forming wire;
guide means within each of the first and second forming wires to converge them to define a throat, and to diverge them downstream thereof at the end of their co-running path of travel;
a secondary headbox for supplying a stream of stock to the throat to initiate formation of a top web ply between the first and second forming wires;
a curved forming shoe within the second looped forming wire for dewatering the top web ply through its second face surface;
a first auto-slice within the first looped forming wire downstream of the forming shoe;
a first curved dewatering shoe disposed within the second forming wire downstream of the first auto-slice;
a second curved dewatering shoe connected to a source of vacuum and disposed within the first looped forming wire downstream of the first curved dewatering shoe for dewatering the top web ply through its first face surface;
a web transfer box disposed within the second forming wire near where the wires diverge for urging the web onto the second forming wire;
guide means within the second looped forming wire to direct said second forming wire and top web ply onto the base ply on the base ply forming wire and maintaining the top web ply and base ply between the second forming wire and base ply forming wire for a distance of co-running travel together;
a base ply dewatering shoe disposed within the looped base ply forming wire and extending thereagainst to place the multi-ply web between the second and base ply forming wires in compression and receiving water expressed through the base ply forming wire.

8. The apparatus as set forth in claim 7, wherein:
the surface of the base ply dewatering shoe is convexly curved toward the second forming wire.

9. The apparatus as set forth in claim 7, further including:
a pressure foil disposed within the second forming wire downstream of the curved first dewatering shoe for urging water through the first forming wire to be gathered by a second auto-slice.

10. A method for forming a multi-ply paper fiber web in conjunction with a fourdrinier wire on a fourdrinier-type papermaking machine, the method comprising the steps:
forming a base ply web on the fourdrinier wire;
forming at least a single top ply web on a top former by
bringing first and second looped forming wires into co-running opposed array in a co-running path of travel above the fourdrinier wires,
guiding the first and second forming wires to converge them to define a throat and to diverge them downstream thereof at the end of their co-running path of travel,
supplying a stream of stock to the throat to initiate formation of a top ply web having first and second face surfaces between the first and second forming wires,
dewatering the top ply web through its second face surface over a curved forming shoe within the second looped forming wire,
skimming free water with a first auto-slice from the inside of the first looped forming wire downstream of the forming shoe,
dewatering the top ply web over a first curved dewatering shoe within the second forming wire downstream of the first auto-slice,
dewatering the top ply web through its first surface over a second curved dewatering shoe which is operated with vacuum assistance downstream of the first curved dewatering shoe and disposed within the first looped forming wire,
transferring the top ply web onto the second forming wire,
bringing the first base surface of the top ply web into contact with the base ply on the fourdrinier wire to ply-bond the webs together.

11. The method of forming a multi-ply paper web as set forth in claim 10, wherein:
the step of forming the base ply includes the steps of
(a) bringing a looped base ply top wire into a co-running relationship with the fourdrinier wire for a distance together,
(b) forming a throat near the point of convergence of the base ply top wire and fourdrinier wire,
(c) projecting a stock stream into the throat to begin formation of the base ply.

12. A method of forming a multi-ply paper web comprising the steps:
projecting a stock stream onto a looped base ply forming wire for forming a base ply web thereon;
looping first and second forming wires in opposed array in a co-running path of travel above the base ply forming wire;
guiding the first and second forming wires to converge and define a throat, and to diverge them downstream thereof at the end of their co-running path of travel;
supplying a secondary stream of stock to the throat to initiate formation of a top web ply between the first and second forming wires;
dewatering the top ply web over a curved forming shoe within the second looped forming wire through its second face surface;
skimming the free water with a first auto-slice within the first looped forming wire downstream of the forming shoe;
dewatering the web over a first curved dewatering shoe disposed within the second forming wire downstream of the first auto-slice;
dewatering the top ply web through its first face surface over a second curved dewatering shoe operated with vacuum assistance downstream of the first curved dewatering shoe and disposed within the first looped forming wire;

transferring the top ply web onto the second forming wire;

guiding the top ply web onto the base ply web and maintaining the top ply web and base ply web between the second forming wire and base ply forming wire for a distance of co-running travel together;

dewatering the multi-ply web between the second and base fourdrinier wires over a base ply dewatering shoe disposed within the looped base ply forming wire.

* * * * *